US007278649B2

(12) United States Patent
Daniels

(10) Patent No.: US 7,278,649 B2
(45) Date of Patent: Oct. 9, 2007

(54) WHEELCHAIR COVER

(76) Inventor: Annmarie Daniels, 1 Wharf St., Nahant, MA (US) 01908

( * ) Notice: Subject to any disclaimer, the term of this patent is extended or adjusted under 35 U.S.C. 154(b) by 117 days.

(21) Appl. No.: 11/219,602

(22) Filed: Sep. 2, 2005

(65) Prior Publication Data

US 2007/0052268 A1 Mar. 8, 2007

(51) Int. Cl.
*A61G 5/10* (2006.01)
*A47C 31/00* (2006.01)
*A47C 7/62* (2006.01)

(52) U.S. Cl. ..... 280/304.1; 297/DIG. 4; 297/228; 297/188.01; 297/288.1

(58) Field of Classification Search ..... 297/228, 297/227, 219.1, DIG. 4, 228.1, 223, 225, 297/228.12, 228.13, 229, 188.18, 188.2, 297/DIG. 6; 280/304.1, 770, 250.1; 150/158, 150/166

See application file for complete search history.

(56) References Cited

U.S. PATENT DOCUMENTS 2,757,718 A * 8/1956 Lenz ..... 297/228
3,695,690 A * 10/1972 Carson ..... 297/218.3
4,036,524 A * 7/1977 Takamatsu ..... 297/219.1
4,101,143 A * 7/1978 Sieber ..... 280/42
4,693,289 A * 9/1987 Taylor et al. ..... 150/166
5,121,938 A * 6/1992 Gross et al. ..... 280/304.1
5,154,331 A 10/1992 Sanders
5,170,826 A * 12/1992 Carstensen et al. ..... 150/154
5,592,997 A * 1/1997 Ball ..... 180/65.1
5,690,380 A 11/1997 Waters
6,481,736 B1 * 11/2002 Chan ..... 280/288.4
6,561,588 B1 * 5/2003 Brady ..... 297/423.4
6,866,337 B1 3/2005 Lash
2005/0173953 A1 * 8/2005 Riley ..... 297/228.1

FOREIGN PATENT DOCUMENTS

GB 2168018 * 6/1986

* cited by examiner

*Primary Examiner*—Milton Nelson, Jr.
(74) *Attorney, Agent, or Firm*—Dale J. Ream

(57) ABSTRACT

Disclosed herein is a wheelchair cover having a first covering member and a second covering member. The first covering member has a back cover portion covering a back of a wheelchair, and a first and a second arm covering portions for covering a first and a second arm extending from said back of said wheelchair. The second covering member, removably attached to the first covering member has a seat covering portion for covering a seat of the wheelchair. The wheelchair cover further comprises a third covering member covering a cushion placed on the seat. A first and second side skirt extending from the first and second arm covering portions covers the first and second side of the wheelchair and a back skirt extending from said back covering portion for covering a wheelchair back side. A front skirt from second covering member covers a wheelchair front side.

10 Claims, 5 Drawing Sheets

WHEELCHAIR COVER

FIELD OF THE INVENTION

The present invention relates to wheelchair accessories and more particularly to wheelchair covers for providing an aesthetic look to the back rest, seat and the handle portions.

BACKGROUND OF THE INVENTION

Wheelchairs have been in use since decades in hospitals, nursing homes, and in homes for personal use. These wheelchairs in terms of their mechanical parts involved generally have an ugly outlook and are repulsive to some users. It necessitates the need for wheelchair covers for providing a net look to the entire unit and components in specific. Wheelchair covers have been used to cover the wheelchairs, such that, the wheelchairs may appear as regular slipcovered or upholstered chairs. Some of the wheelchair covers used are one-piece units that cover both the seat and back of the wheelchair. These covers lack universal fit with a multitude of wheelchair sizes. Moreover, the entire cover must be removed and replaced if either the seat portion or the back portion becomes soiled. Also, most of theses wheelchair covers do not have an aesthetic appearance. In some cases, the wheelchair user may have to carry or transport medical equipment or other accessories.

U.S. Pat. No. 6,866,337 discloses a protective cover for a wheelchair having a first cover section and a second cover section, such that, the protective cover wraps around either a seat or back of the wheelchair. The protective cover of the invention does not cover the side arms of the wheelchair and in whole does not provide as good an aesthetic appearance to the wheelchair. Also, the protective cover does not have any means for carrying other accessories of the user.

U.S. Pat. No. 5,690,380 describes a one-piece slipcover, supplemented by optional, interchangeable trim components, intended for lightweight folding or non-folding chairs. The cover is designed to give a loose, draped appearance and does not in any way simulate a custom fitted design, an important aspect for wheelchairs.

U.S. Pat. No. 5,154,331 discloses a wheelchair arms rest and storage pouch that can be used for resting the arms and for string and carrying user equipments. The arm rest and pouch of the disclosure do not cover the back portion and seat portion of a wheel chair and cannot substitute a wheelchair cover.

Accordingly, there remains a need for different wheelchair covers that while providing comfort and convenience to a user also provide an aesthetic look to the wheelchair, such that, the wheelchair is as attractive as an upholstered or slipcovered piece of furniture.

SUMMARY OF THE INVENTION

In view of the foregoing disadvantages inherent in the above-mentioned prior arts, the general purpose of the present invention is to provide a wheelchair cover, to include all the advantages of the prior arts, and to overcome the above-mentioned disadvantages/drawbacks of the prior art.

In one aspect of the present invention, a wheelchair cover comprises a first covering member and a second covering member. The first covering member has a back cover portion covering a back of wheelchair, a first and second arm covering portions for covering a first arm and a second arm extending from the back of the wheelchair. The second covering member has a seat covering portion for covering a seat of the wheelchair. The second covering member is removably attached to the first covering member.

In another aspect of the present invention, a wheelchair cover also comprises a third covering member covering a cushion placed on the seat of the wheelchair. The first covering member of the wheelchair further has a first and second side skirts extending from the first and second arm covering portions for covering a first side and a second side of the wheelchair. The wheelchair further has a back skirt extending from the back covering portion for covering a back side of said wheelchair.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated exemplary embodiments of the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Like reference numerals refer to like parts throughout several views of the drawings.

DETAILED DESCRIPTION OF THE INVENTION

Figure 1:
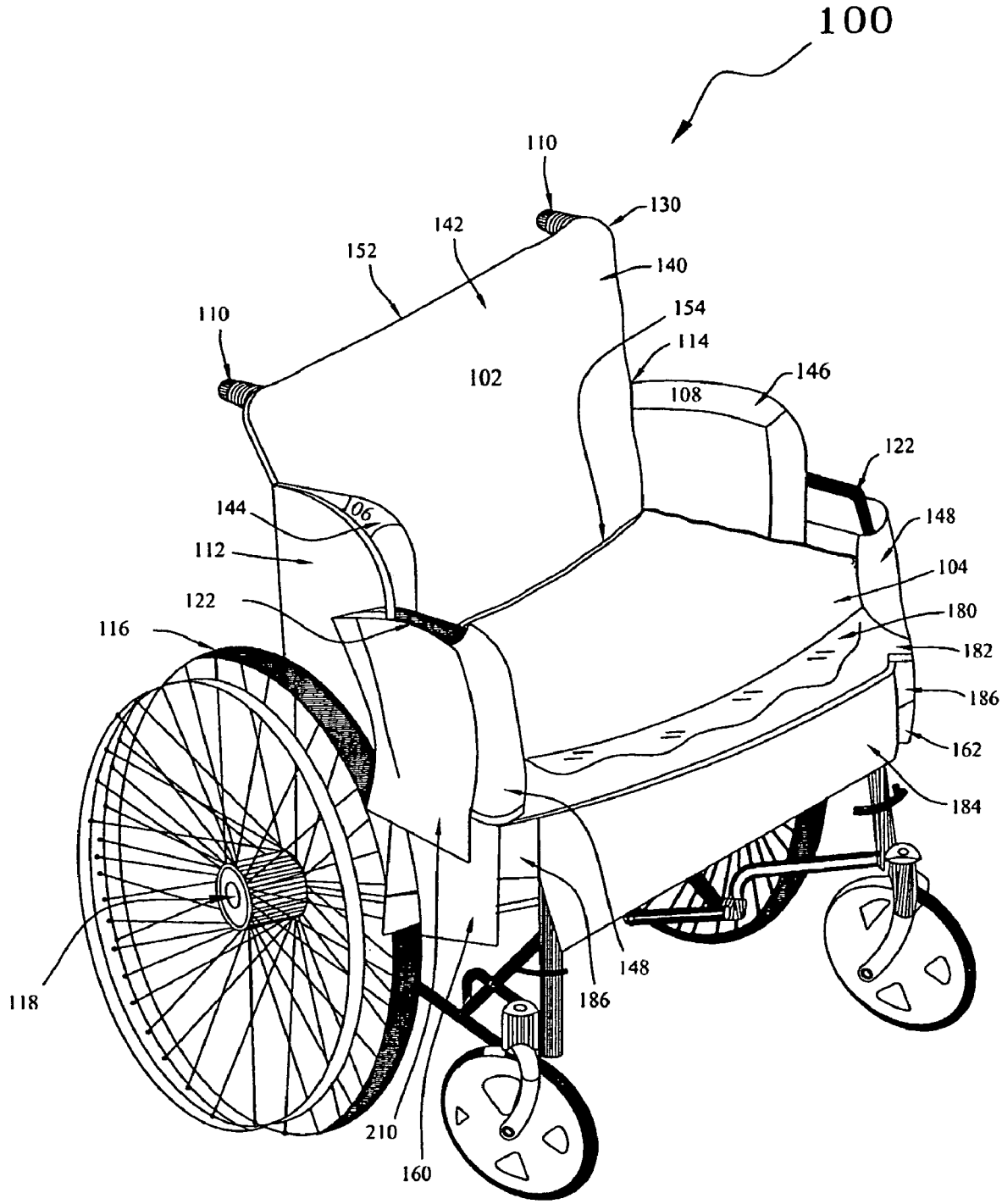
FIG. 1 is a perspective view of a 'desk-arm' type wheelchair 100 with a wheelchair cover 130, according to an exemplary embodiment of the present invention.

The exemplary embodiments described herein detail for illustrative purposes are subject to many variations in structure and design. It should be emphasized, however that the present invention is not limited to a particular wheelchair cover as shown and described. Rather, the principles of the present invention can be used with a variety of configurations and structural arrangements, e.g., for aesthetics, structural purposes, and/or for simplicity in shipping and storage. It is understood that various omissions, substitutions of equivalents are contemplated as circumstances may suggest or render expedient, but is intended to cover the application or implementation without departing from the spirit or scope of the claims of the present invention.

The present invention provides wheelchair cover that while providing comfort and convenience to a user makes a wheelchair look as an upholstered or slipcovered piece of furniture. The present invention further provides wheelchair cover with pockets to keep equipments that need to be carried by a wheelchair user.

Referring now to FIGS. 1-4 a wheelchair 100, 300 is covered with a wheelchair cover 130, 330. The wheelchair 100 is a desk-arm type wheelchair, and as used herein, a desk-arm type wheelchair refers to a wheelchair that has a first arm 106 extending from a back 102 on a first side 112 of the wheelchair 100, a second arm 108 extending from the back 102 on a second side 114, and hand pipes 122 extending from the arms 106, 108 at a height lower than a height at which the arms extend form the back 102 of the wheelchair. The wheelchair 300 is a full-arm type wheelchair, and as used herein, refers to a wheelchair that has a first arm 306 extending from a back 302 on a first side 312 of the wheelchair 300 and a second arm 308 extending from the back 302 of the wheelchair 300; and does not have any kind of hand pipes. When comparing the desk-arm type wheelchair 100 with full-arm type wheelchair 300, it can be seen that desk-arm type wheelchair 100 has shorter arm lengths than the full-arm type wheelchair 300 (See FIGS. 1 and 3), since a part of the length on the sides is occupied by a length of the hand pipes 122 of the wheelchair 100.

The wheelchair cover 130, 330 comprises a first covering member 140, 340 having a back covering portion 142, 342, a first arm covering portion 144, 344, and a second arm covering portion 146, 346. The back covering portion 142, 342 has two handle openings (not shown) on either side of a top end 152, 352, such that, the first covering member 140, 340 slips on easily over back handles 110,310, sliding down between the first side 112, 312 and the second side 114, 314, thereby the back covering portion 142, 342 covering the back 102, 302, the first arm covering portion 144, 344 covering the first arm 106, 306, and the second arm covering portion 146, 346 covering the second arm 108, 308.

Figure 1A:
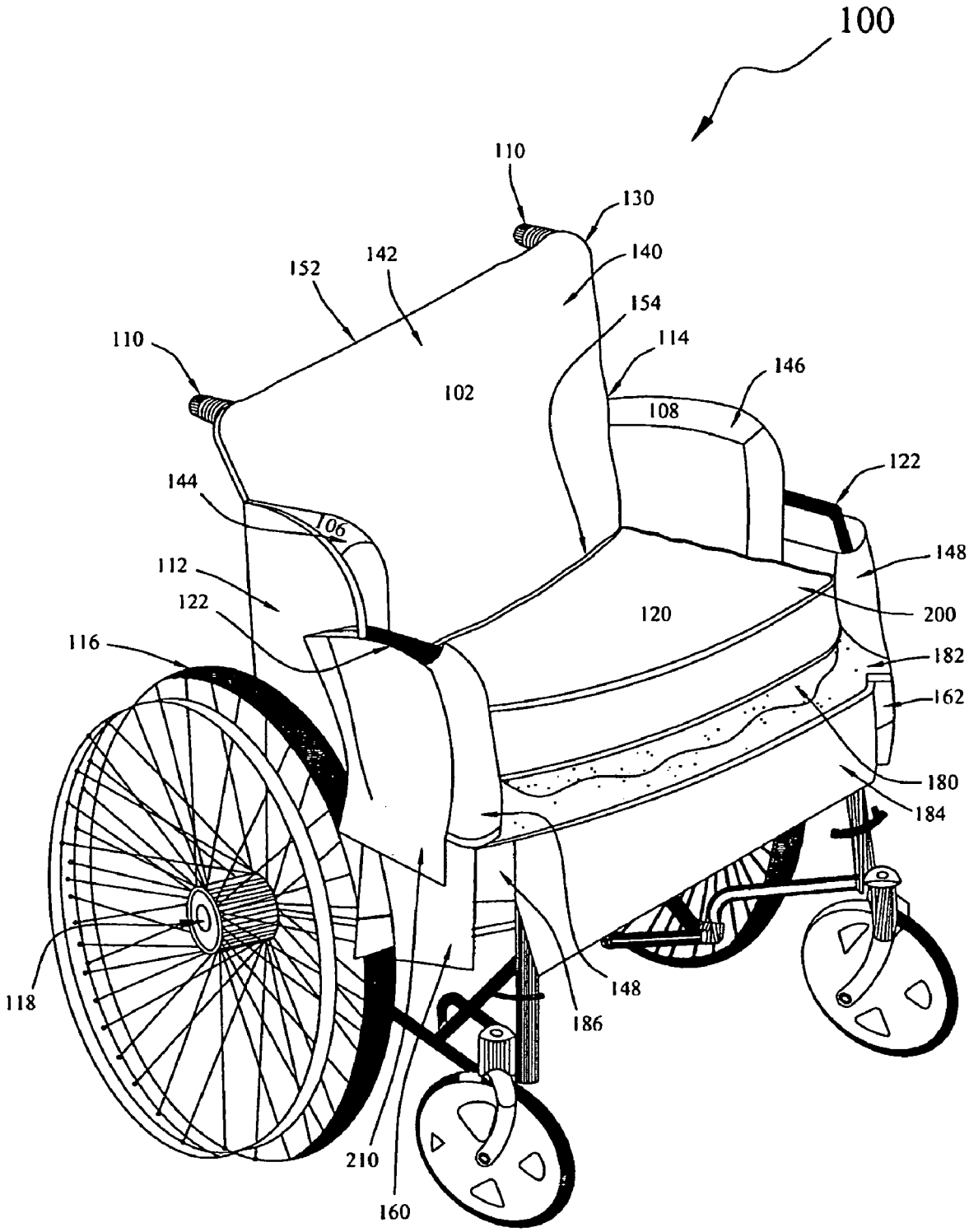
FIG. 1A is a perspective view of the 'desk-arm' type wheelchair 100 with the wheelchair cover 130, and with a cushion 120, according to an exemplary embodiment of the present invention.
Figure 2:
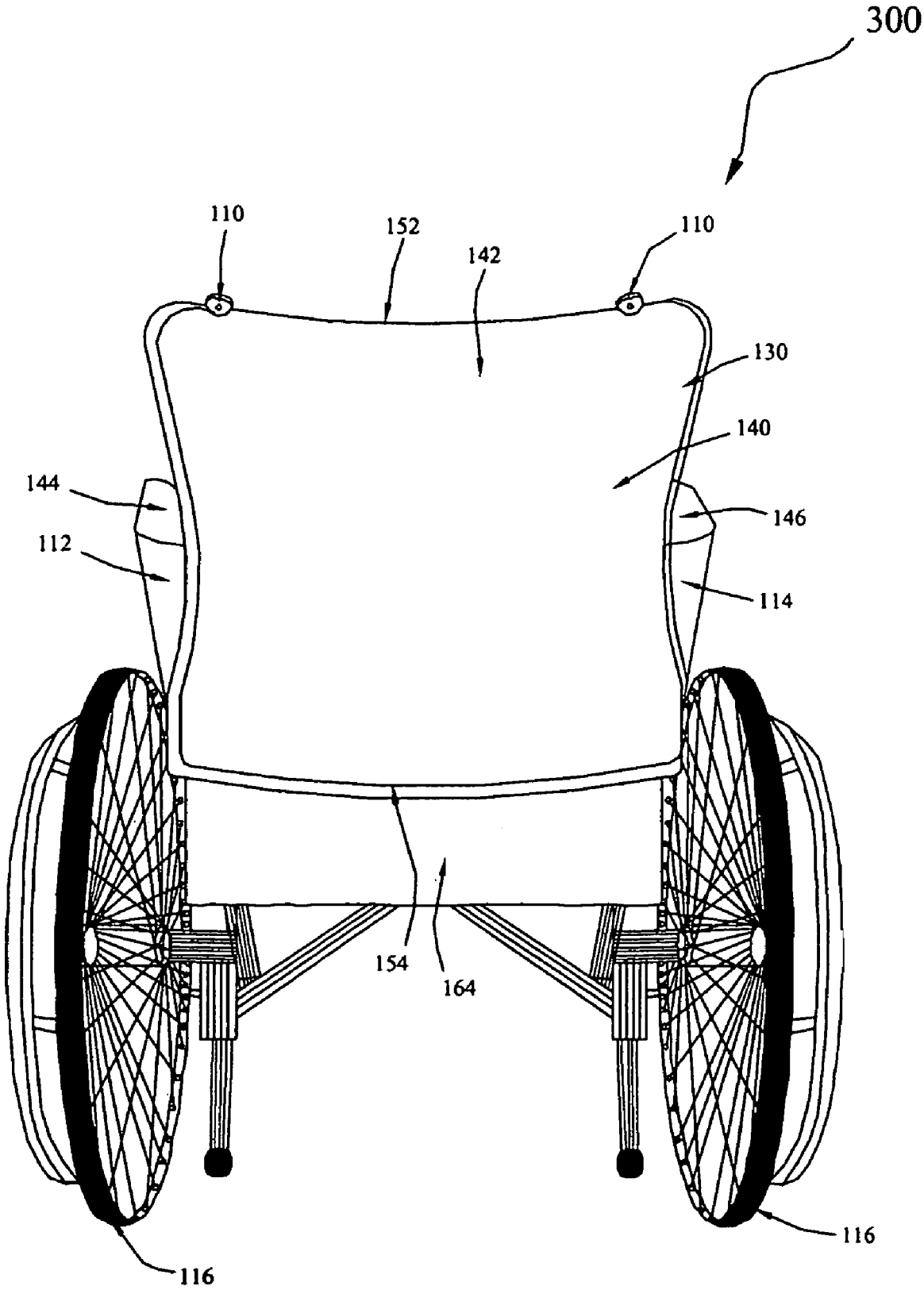
FIG. 2 is a back view of the 'desk-arm' type wheelchair 100 with the wheelchair cover 130, according to an exemplary embodiment of the invention.
Figure 4:
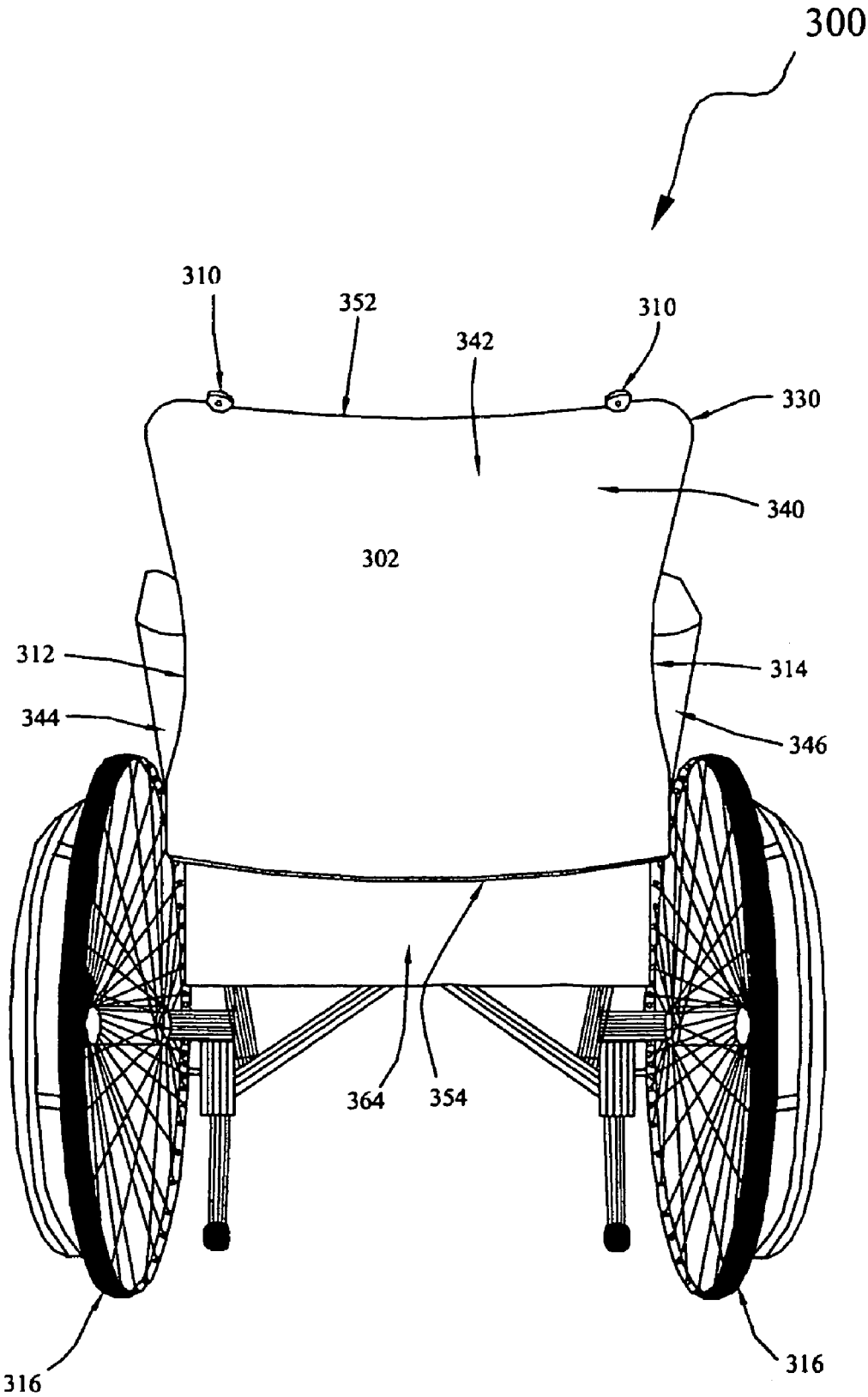
FIG. 4 is a back view of the 'full-arm' type wheelchair 300 with the wheelchair cover 330, according to an exemplary embodiment of the present invention.

The first covering member 140, 340 further has a first side skirt 160, 360 extending from the first arm covering portion 144, 344 up to a wheel axle 118, 318 of wheels 116, 316 covering the first side 112, 312 of the wheelchair 100, 300; a second side skirt 162, 362 extending form the second arm covering portion 146, 346 up to the wheel axle 118, 318 of wheels 116, 316 covering the second side 114, 314 of the wheelchair 100, 300; and a back skirt 164, 364 [see FIG. 2 and FIG. 4] extending from the back covering portion 142, 342 up to the wheel axle 118, 318 of the wheels 116, 316 covering a back side of the wheelchair 100, 300. Also, the first covering member 140 for the 'desk-arm' type wheelchair 100 further has extension cover portions 148 that wrap around a portion of hand pipes 122 along the length of hand pipes 122. A remaining portion of hand pipes 122 is not covered, as illustrated in the FIGS. 1 and 1A. The remaining portion may be held by a wheelchair user for controlling the movement of the wheelchair 100, 300.

The first side skirt 160, 360 and/or the second side skirt 162, 362 may be split to from an opening 366 (See FIG. 3) to allow access to control elements (e.g. brake handles 368, and the like) on the first side 112,312 and also on the second side 114,314 [not shown] of the wheelchair 100, 300.

The wheelchair cover 130, 330 further comprises a second covering member 180, 380 having a seat covering portion 182, 382 and a front skirt 184, 384. The second covering member 180, 380 may be removably attached to the first covering member 140, 340 at a bottom end 154 and 354 on the first side 112, 312 and the second side 114, 314 using attachment means, as shown in FIG. 2 and FIG. 4 such that, the seat covering portion 182, 382 covers the seat 104 as shown in FIG. 1 (seat not shown for the wheelchair 300), and the front skirt 184, 384 covers a front side of the wheelchair 100, 300. Useful attachment means include, but are not limited to, Velcro snaps, buttons, zippers, and the like. For example, the first covering member 140, 340 has fabric flaps (not shown) on each side at the bottom end 154, 354 [FIG. 2 and FIG. 4] with features stitched on them, that attach with Velcro complementary features stitched on an inside surface of second covering member 180, 380. Since the second covering member 180, 380 covering the seat 104 can be easily detached from the first covering member 140, 340, the second covering member 180, 380 can be sent for cleaning without having to remove the first covering member 140, 340 from the wheelchair 100, 300.

The second covering member 180, 380 further has fabric flaps 186, 386 with Velcro features on first side 112, 312 and the second side 114, 314 that attach with the first side skirt 160, 360 and the second side skirt 162, 362 on a front end of the seat 104 in front of the openings 366 that allow access to handle brakes 368 of the wheelchair 100, 300. The fabric flaps 186 are distanced between the front skirt 184, 384 and side skirts (i.e., first side skirt 160, 360 and second side skirt 162, 362) to accommodate a pipe [not shown] of footplates [not shown] (footplates may be optionally present on wheelchairs). The front skirt 184, 384 would fall between the pipe [not shown] on either side, when footplates [not shown] are attached. Optionally, a gap (not shown) in left open at a back of the seat covering portion 182, 382 to enable a person closing up the wheelchair 100, 300 to get a grip on the seat 104.

The wheelchair 100, 300 may further have a cushion 120, 320 that can be placed on the seat 104 of the wheelchair 100, 300. In such embodiments, the wheelchair cover 130, 330 further comprises a third covering member 200, 400 for covering the cushion 120, 320.

The wheelchair cover 130, 330 may have pockets built into one or more members that can be used to hold a variety of items, such as the user's accessories, medical items, and the like. The 'desk-arm' type wheelchair 100, as shown in FIGS. 1, 1A and 2, have pockets 210 that pull through under the hand pipes 122 and hang on an outside surface of extension cover portions 148. As used herein, an outside surface of extension cover portions 148 is a surface facing the wheels 116 and not facing the seat 104 of the wheelchair 100. In some embodiments, a 'best-fit' for the pockets 210 may be just hanging them over the hand pipes 122.

Figure 3:
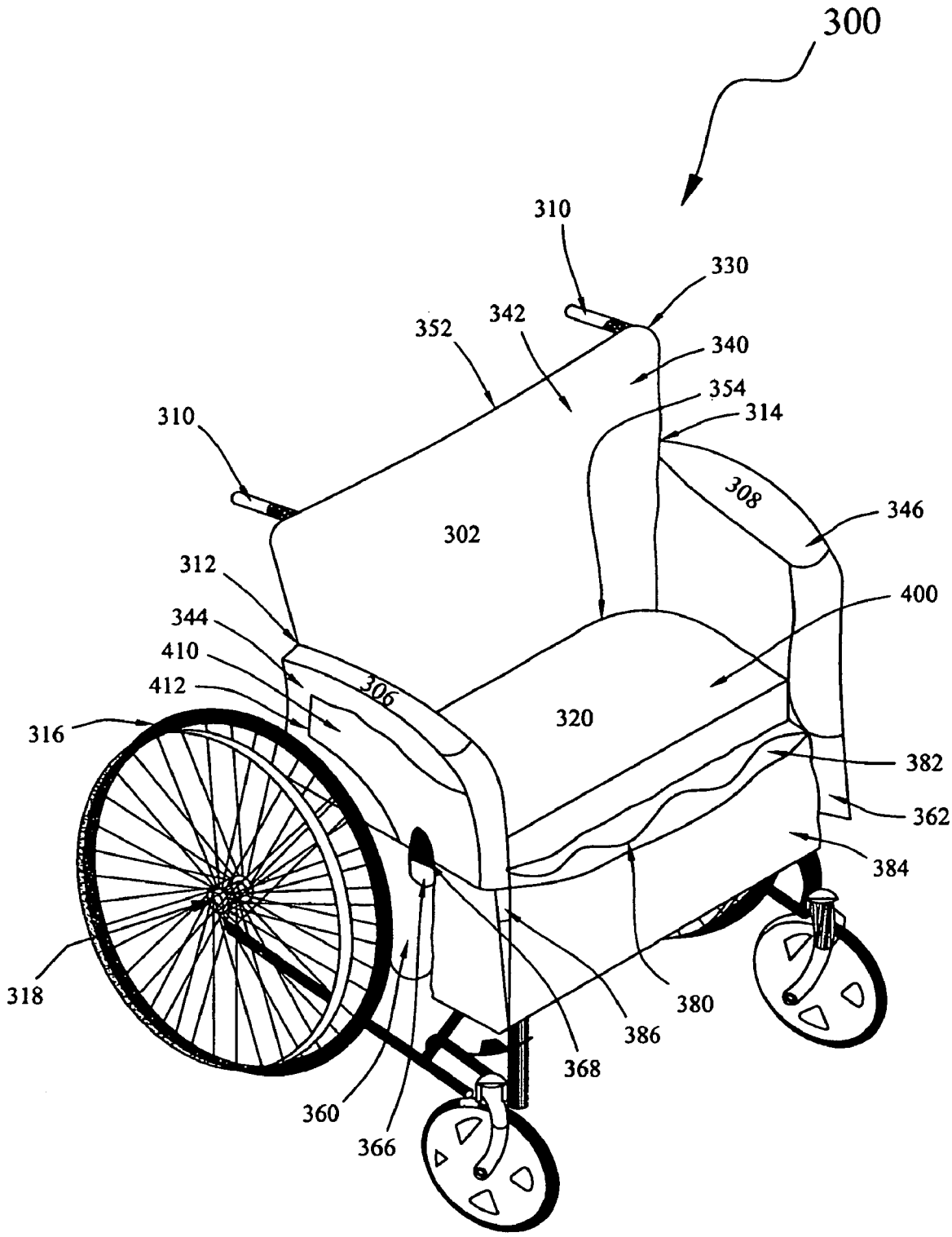
FIG. 3 is a perspective view of a 'full-arm' type wheelchair 300 with a wheelchair cover 330, and with a cushion 320, according to an exemplary embodiment of the present invention.

The 'full-arm' type wheelchair 300, as shown in FIGS. 3 and 4, has patch pockets 410 attached (e.g., stitched) to an outside surface of the first arm covering portion 344 and the second arm covering portion 346. As used herein, an outside surface of the first arm covering portion 344 and second arm covering portion 346 is a surface facing the wheels 316 and not facing the seat (not shown) of the wheelchair 300. The patch pockets 410 have a bottom portion 412 that is arched to follow the curvature of the wheel 316.

The wheelchair covers 130, 330 may be available in different sizes to fit to dimensions of different available wheelchairs.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

The invention claimed is:

1. A wheelchair cover, comprising:

a first covering member having a back covering portion covering a back of a wheelchair, and a first and a second arm covering portions for covering a first and a second arm extending from said back of said wheelchair;

a second covering member having a seat covering portion for covering a seat of said wheelchair, said second covering member is removably attached to said first covering member;

hand pipes extending from said first and said second arms at a height lower than a height at which said first and second arms extend from said back of said wheelchair; and wherein said first covering member further has extension cover portions for wrapping around a portion of said hand pipes along a length of said hand pipes.

2. The wheelchair cover of claim 1, wherein said wheelchair cover further comprises a third covering member covering a cushion placed on said seat of said wheelchair.

3. The wheelchair cover of claim 1, wherein said first covering member further has a first side skirt extending from said first arm covering portion for covering a first side of said wheelchair.

4. The wheelchair cover of claim 1, wherein said first covering member further has a second side skirt extending from said second arm covering portion for covering a second side of said wheelchair.

5. The wheelchair cover of claim 1, wherein said first covering member further has a back skirt extending from said back covering portion for covering a back of side said wheelchair.

6. The wheelchair cover of claim 1, wherein said second covering member further has a front skirt for covering a front side of said wheelchair.

7. The wheelchair cover of claim 1, wherein at least one pocket is disposed on an outside surface of said extension cover portions.

8. The wheelchair cover of claim 1, wherein said first covering member and said second covering member are attached by using at least one of hook and loops snaps, buttons and zip.

9. The wheelchair cover of claim 1, wherein at least one pocket is disposed on an outside surface of said first and said second arm covering portions.

10. The wheelchair cover of claim 9, wherein said pocket has an arched bottom to follow a curvature of a wheel of said wheelchair.

* * * * *